US007621600B2

(12) United States Patent
Buchbinder

(10) Patent No.: US 7,621,600 B2
(45) Date of Patent: Nov. 24, 2009

(54) SEAT FRAMES HAVING APPEARANCE OF ONE-PIECE CONSTRUCTION AND SEAT FRAMES HAVING A BACK SUPPORT DESIGN DERIVED FROM THE FRAME

(76) Inventor: Michael C. Buchbinder, 16702 Wanderer La., Huntington Beach, CA (US) 92649

( * ) Notice: Subject to any disclaimer, the term of this patent is extended or adjusted under 35 U.S.C. 154(b) by 0 days.

(21) Appl. No.: 11/757,592

(22) Filed: Jun. 4, 2007

(65) Prior Publication Data

US 2007/0284931 A1 Dec. 13, 2007

Related U.S. Application Data

(60) Provisional application No. 60/811,907, filed on Jun. 8, 2006.

(51) Int. Cl.
*A47C 7/02* (2006.01)
*A47C 1/12* (2006.01)

(52) U.S. Cl. ..... 297/452.19; 297/446.2; 297/447.3; 297/448.1; 297/447.2

(58) Field of Classification Search ..... 297/447.3, 297/447.2, 440.11, 446.1, 446.2, 447.1, 448.1, 297/452.19, 452.2; 29/428
See application file for complete search history.

(56) References Cited

U.S. PATENT DOCUMENTS

| | | | | | |
|---|---|---|---|---|---|
| D133,550 | S | | 8/1942 | Meyers | D6/334 |
| D156,448 | S | | 12/1949 | Marbereit | D6/334 |
| 2,631,655 | A | * | 3/1953 | Jannello | 297/447.2 |
| 2,649,136 | A | * | 8/1953 | Eames | 297/295 |
| 2,649,147 | A | * | 8/1953 | Sanford | 297/411.41 |
| 2,677,413 | A | * | 5/1954 | Pernecky Jr, et al. | 297/239 |
| 2,692,637 | A | * | 10/1954 | Rainwater | 297/344.18 |
| D178,505 | S | | 8/1956 | Duer | D6/334 |
| 2,788,846 | A | | 4/1957 | Hauser | 297/446.2 |
| 3,152,836 | A | | 10/1964 | Swan | 297/446.1 |
| 3,756,656 | A | * | 9/1973 | Weick | 297/451.3 |
| D233,963 | S | | 12/1974 | Welton | D6/375 |
| D238,321 | S | | 1/1976 | Lindau et al. | D6/374 |
| 3,999,802 | A | * | 12/1976 | Powers | 297/447.3 |
| 4,202,581 | A | * | 5/1980 | Fleishman | 297/440.13 |
| 4,210,182 | A | * | 7/1980 | Danko | 144/349 |
| D271,455 | S | | 11/1983 | Saiger | D6/500 |
| D282,800 | S | | 3/1986 | Sorensen | D6/500 |
| D282,985 | S | | 3/1986 | Cronk | D6/373 |

(Continued)

OTHER PUBLICATIONS

Michael C. Buchbinder, pending Divisonal U.S. Appl. No. 29/280,640, filed Jun. 4, 2007 entitled "Seat Frame".

(Continued)

*Primary Examiner*—Milton Nelson, Jr.
(74) *Attorney, Agent, or Firm*—Heslin Rothenberg Farley & Mesiti P.C.

(57) ABSTRACT

A seat frame is manufactured from a single continuous elongated member or which has the appearance of being formed from a single continuous elongated piece of material. For example, the seat frame may be formed from a single continuous elongated member such as a tube or wire which is bent or twisted into shape. Alternatively, a plurality of elongated members generally having similar cross-sections may be used to form the seat frame, which has the appearance of one-piece construction. The back may be integral with the seat frame thereby not requiring additional back support material. Further, the back may represent an abstract or a recognizable object.

33 Claims, 9 Drawing Sheets

U.S. PATENT DOCUMENTS

| | | | | |
|---|---|---|---|---|
| 4,674,795 | A | 6/1987 | Nelson | 297/239 |
| 4,676,553 | A | 6/1987 | Lange | 297/446.1 |
| D293,519 | S | 1/1988 | Conn | D6/373 |
| D299,293 | S | 1/1989 | Nelson | D6/372 |
| 5,040,847 | A * | 8/1991 | Nguyen | 297/447.1 |
| D329,156 | S | 9/1992 | Hess | D6/500 |
| D333,750 | S | 3/1993 | Hess | D6/500 |
| D427,796 | S | 7/2000 | Smith | D6/373 |
| D472,723 | S | 4/2003 | Haney et al. | D6/373 |
| D472,745 | S | 4/2003 | Haney et al. | D6/502 |
| D493,973 | S | 8/2004 | Olson | D6/373 |
| D535,841 | S | 1/2007 | Egger | D6/201 |
| 2005/0187083 | A1 * | 8/2005 | Krystoff | 482/140 |

OTHER PUBLICATIONS

Michael C. Buchbinder, pending Design U.S. Appl. No. 29/261,170, filed Jun. 8, 2006 entitled "Seat Frame".

* cited by examiner

SEAT FRAMES HAVING APPEARANCE OF ONE-PIECE CONSTRUCTION AND SEAT FRAMES HAVING A BACK SUPPORT DESIGN DERIVED FROM THE FRAME

CLAIMS TO PRIORITY AND CROSS-REFERENCE TO RELATED APPLICATIONS

This application claims the benefit of U.S. Provisional Application No. 60/811,907 filed Jun. 8, 2006 entitled "Seat Frames Having Appearance Of One-Piece Construction And Seat Frames Having A Back Support Design Derived From The Frame." This application is related to commonly owned U.S. design patent application Ser. No. 29/261,170 filed Jun. 8, 2006, entitled "Seat Frame" which has issued as U.S. Pat. No. D550,000 on Sep. 4, 2007, and divisional U.S. design patent application Ser. No. 29/280,640, filed Jun. 4, 2007, entitled "Seat Frame" which has issued as U.S. Pat. No. D558,493 on Jan. 1, 2008. The entire subject matter of these applications is incorporated herein by reference.

FIELD OF THE INVENTION

This invention relates to chairs, and more particularly to chairs and seat frames having the appearance of one-piece construction, and chairs and seat frames having a back support derived from the frame and which may incorporate an integrated design.

BACKGROUND OF THE INVENTION

Conventionally, the construction of chairs typically requires the assembly of different pieces such as legs, seat, back, and arms. This results in the appearance of the chair being assembled from different pieces.

In addition, the back of the chair is typically a planar material or plurality of vertical rails or horizontal rungs attached to the frame to provide a back support for a person sitting on the chair.

There is a need for further chairs and seat frames having the appearance of one-piece construction, and chairs and seat frames having a back support derived from the frame and which may incorporate an integrated design.

SUMMARY OF THE INVENTION

The present invention provides, in a first aspect, a seat frame which includes a plurality of legs, a back, a support for a seat, and wherein the plurality of legs, the back, and the support for the seat form the seat frame having an appearance of being formed from a single continuous elongated piece of material.

The present invention provides, in a second aspect, a method for forming a seat frame in which the method includes forming at least one of a single elongated member and a plurality of elongated members into a plurality of legs, a back, and a support for a seat, and wherein said plurality of legs, said back, and said support for the seat form the seat frame having an appearance of being formed from a single continuous elongated piece of material.

The present invention provides, in a third aspect, a seat frame having a plurality of front legs, a plurality of back legs, a back, a support for a seat, and wherein said back comprises a design that is integral with at least one of said plurality of front legs and said plurality of back legs.

BRIEF DESCRIPTION OF THE DRAWINGS

The present matter which is regarded as the invention is particularly pointed out and distinctly claimed in the concluding portion of the specification. The present invention, however, may best be understood by reference to the following detailed description of various embodiments and the accompanying drawings in which:

DETAILED DESCRIPTION OF THE INVENTION

In one aspect, the present invention is directed to chairs and seat frames manufactured from a single piece of material or which have the appearance of one-piece construction. For example, a seat frame in accordance with the present invention may be formed from a single continuous elongated piece of material such as an elongated member, a tube or a wire which is bent or twisted into shape. Alternatively, a plurality of elongated members having a similar cross-section may be used to form the seat frame having the appearance of one-piece construction.

In another aspect, the present invention is directed to seat frames and chairs in which the back may be integral with the seat frame thereby not requiring additional back support material. Further, the back may represent a recognizable object as described in greater detail below.

Figure 1:
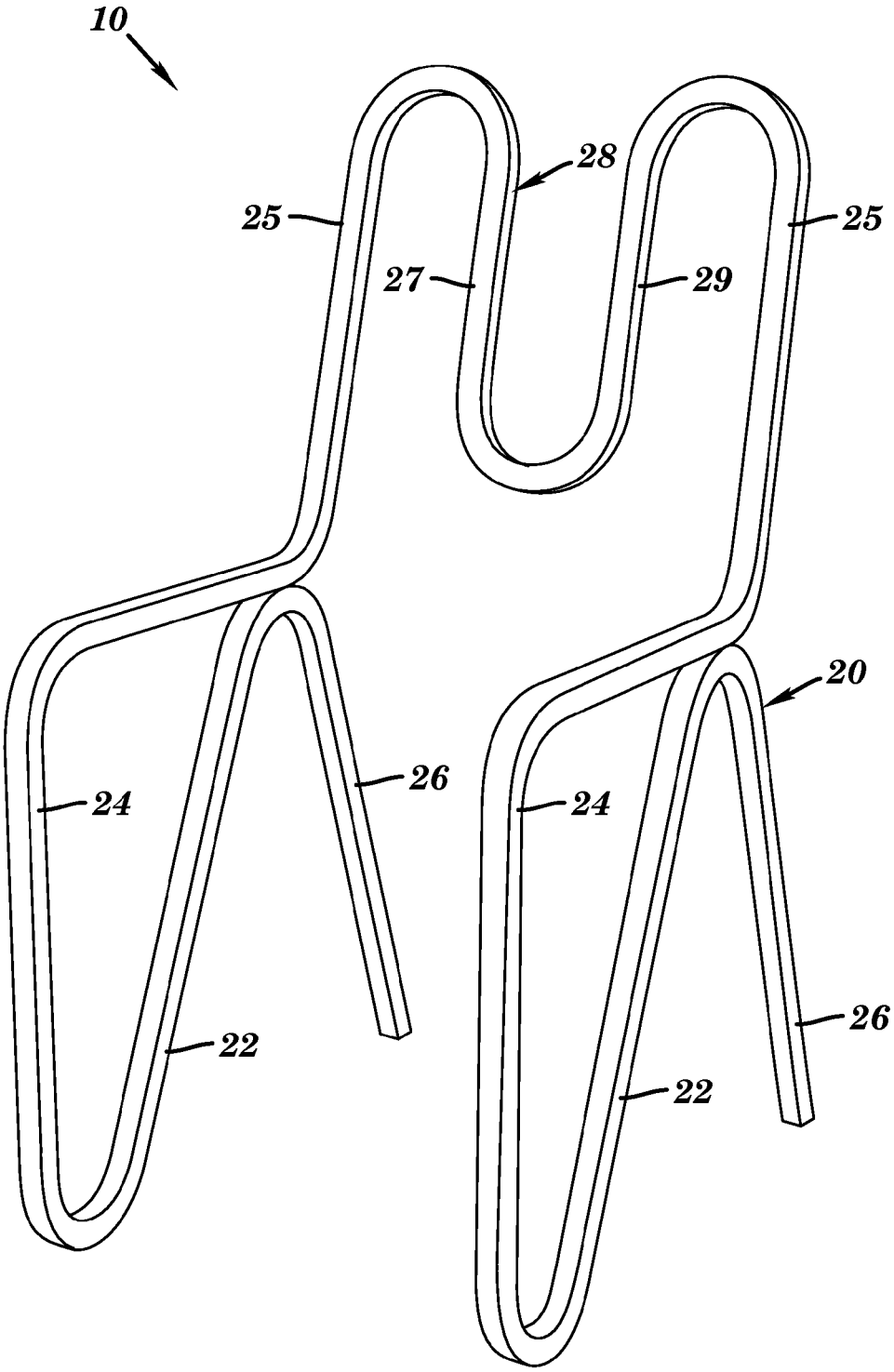
FIG. 1 is a perspective view of one embodiment of a seat frame formed from a single continuous elongated member in accordance with the present invention.

FIG. 1 illustrates one embodiment of a seat frame 10 having a one-piece configuration in accordance with the present invention. As illustrated, a single continuous elongated member 20 may be formed, for example, by bending it into two front legs 24, two back legs 26, a support of the seat, and a back.

Figure 2:
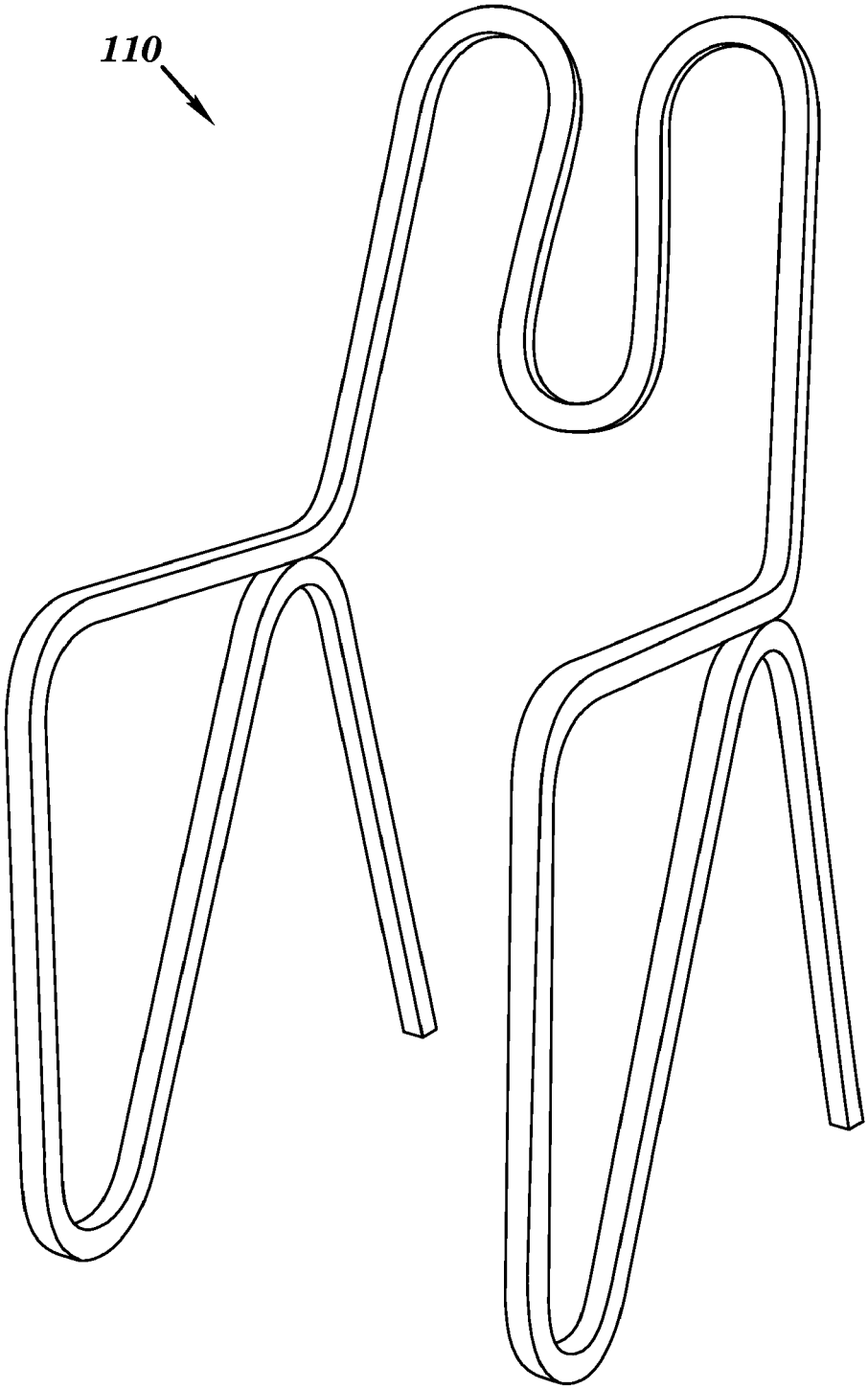
FIG. 2 is a perspective view of another embodiment of a seat frame formed from a single continuous elongated member in accordance with the present invention.
Figure 5:
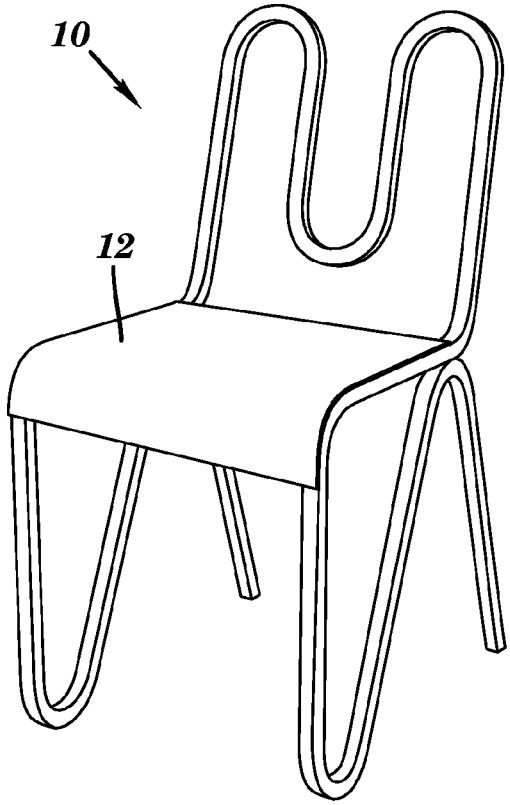
FIG. 5 is a perspective view of the seat frame of FIG. 1 having a seat.

Diagonal portions 22 connect front legs 24 to rear legs 26. The center of the back has a U-shaped portion 28. The back provides two vertical rails 27 and 29, as well as outer vertical rails 25, for supporting the back of a person sitting on the chair. As shown in FIG. 5, additional structural rigidity may be provided by a seat bottom 12 which can be attached to the seat frame by welding or using an adhesive. The attached seat frame and seat bottom may be result in a uni-body construction similar to that found in automobile manufacture. For example, the addition of the seat may provide torsional stability to the chair, and resist twisting. FIG. 2 illustrates a seat frame 110 which is essentially the same as seat frame 10 of FIG. 1 with the back having a tapered configuration.

Figure 3:
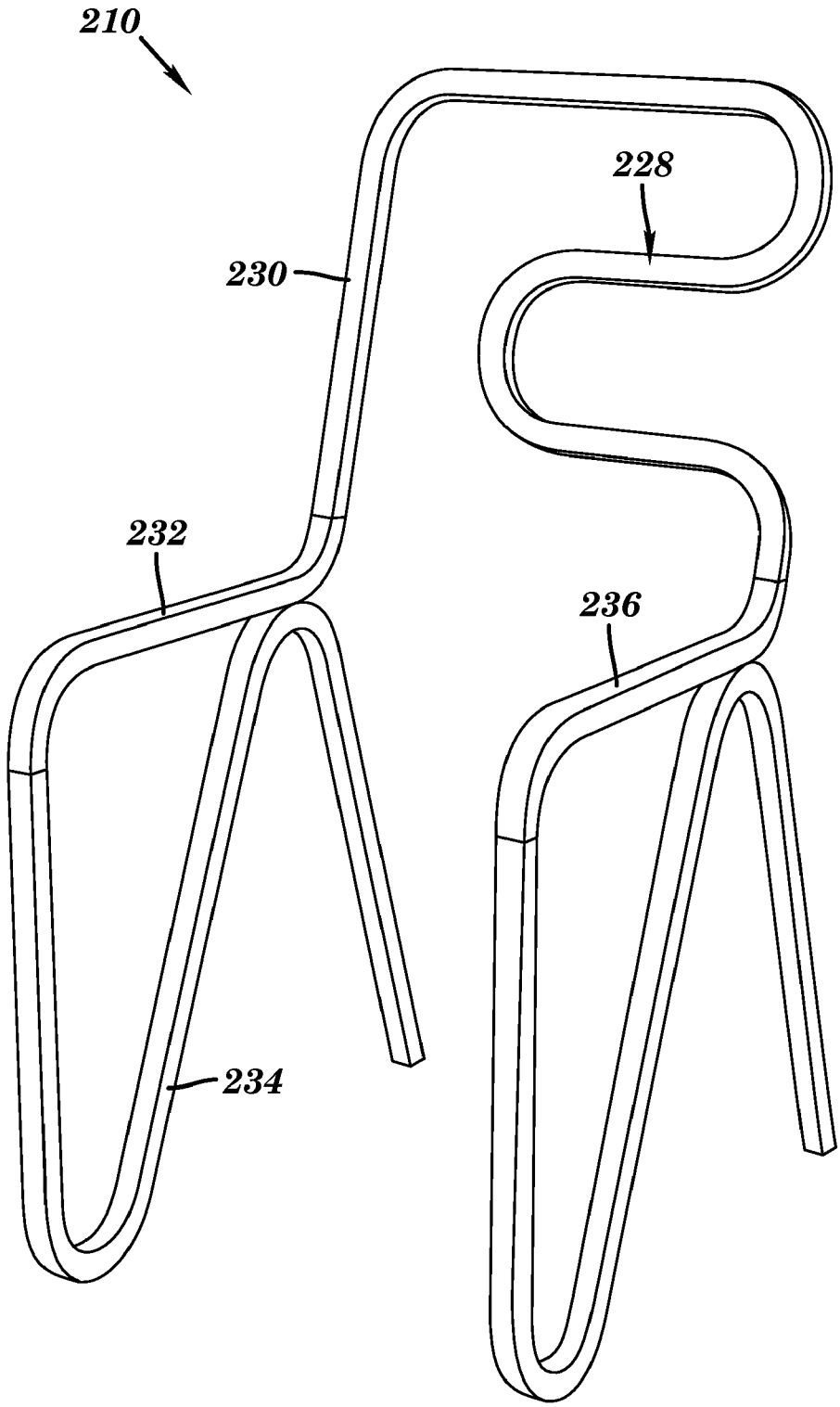
FIG. 3 is a perspective view of one embodiment of a seat frame formed from a plurality of elongated members having the appearance of being formed from a single continuous elongated piece of material in accordance with the present invention.

FIG. 3 illustrates another embodiment of a seat frame 210 having an appearance of a one-piece construction in accordance with the present invention. As illustrated, a plurality of separate generally elongated members 230, 232, 234, and 236 may be formed, for example, by bending into two front legs, two back legs, a support of the seat, and a back. It will be appreciated that more or less pieces may be used in the forming of the one-piece configuration. The pieces may be welded or glued together or attached by other means. It is also possible to have the end of one member fit into the end of a mating member. Aligning the intersection of the members along a horizontal orientation may result in gravity aiding in maintaining the members together. Desirably, the intersection between two adjacent members may be rendered barely visible so that the chair has a generally one-piece appearance.

Figure 4:
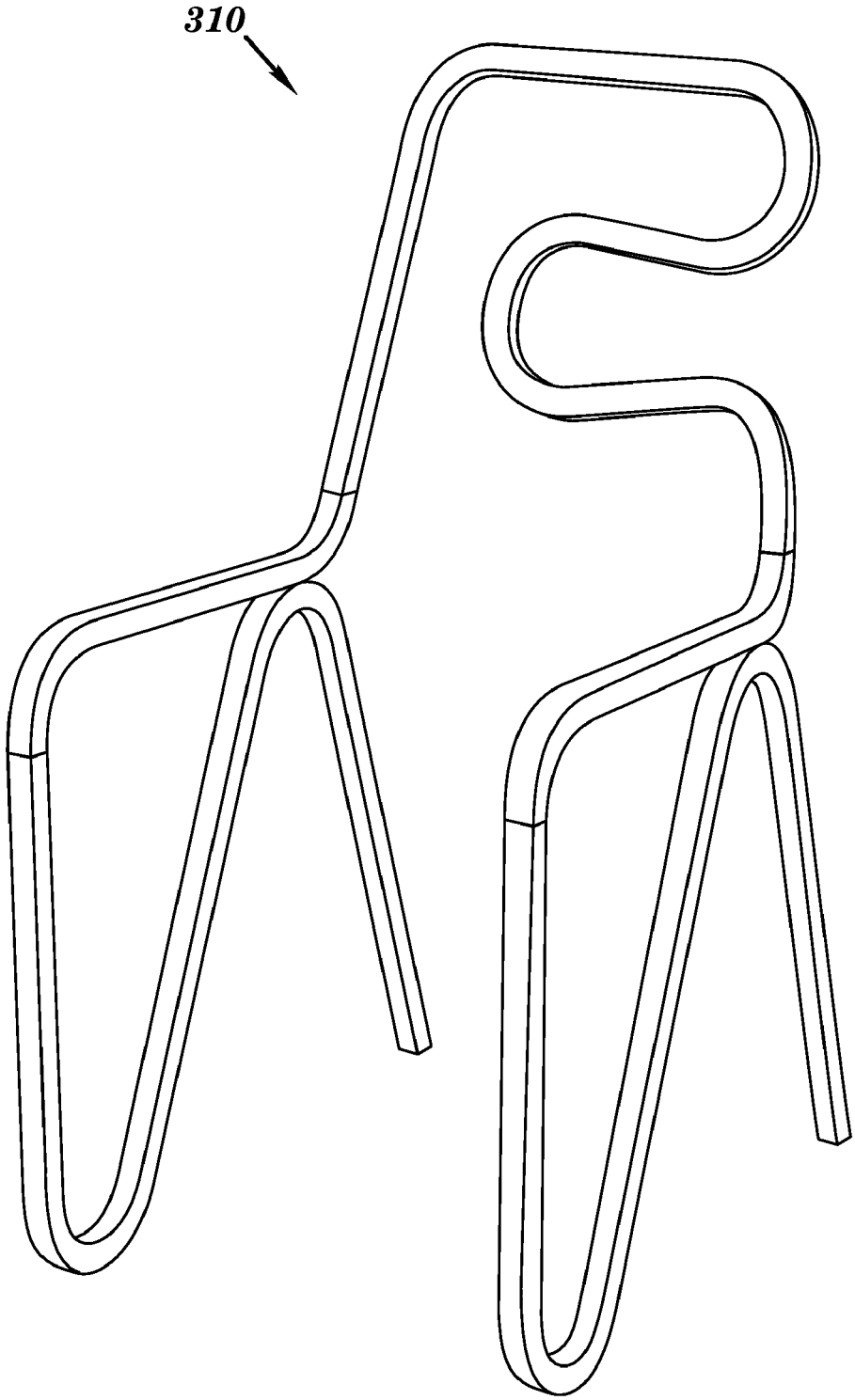
FIG. 4 is a perspective view of another embodiment of a seat frame formed from a plurality of elongated members while having the appearance of being formed from a single continuous piece of material in accordance with the present invention.

A diagonal portion connects the front legs to the rear legs. The center of the back has a sideways U-shaped portion 228. The back provides three horizontal rungs for supporting the back of a person sitting on the chair. Additional structural rigidity may be provided by a seat bottom (such as shown in FIG. 5) which can be attached to the seat frame by welding or an adhesive. The seat frame and seat bottom may result in a uni-body construction similar to that found in automobile manufacture. FIG. 4 illustrates a seat frame 310 which is essentially the same as seat frame 210 of FIG. 3 with the back, and in particular, the sideways U-shaped portion having a tapered configuration.

Figure 6:
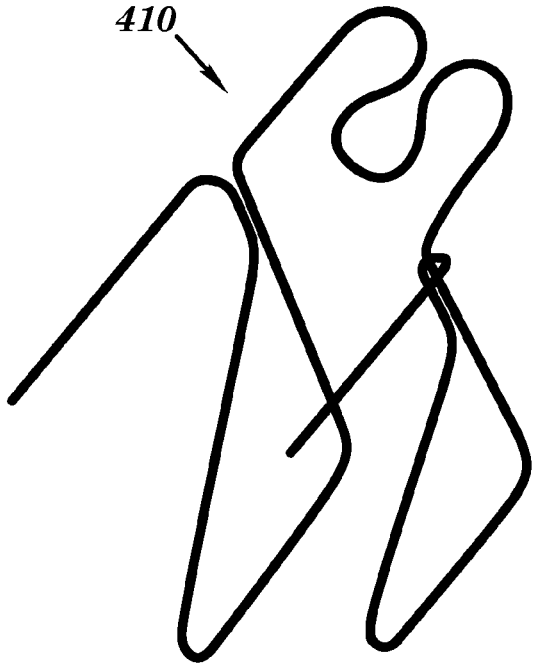
FIG. 6 is a perspective view of another embodiment of a seat frame formed from a single continuous elongated member or having the appearance of being formed from a single continuous elongated piece of material in accordance with the present invention.
Figure 7:
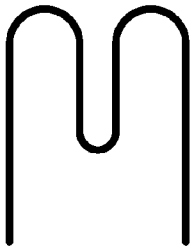
FIGS. 7-21 are various elevational views of backs for a seat frame in accordance with the present invention.
Figure 8:
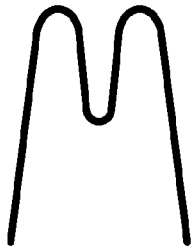
Figure 9:
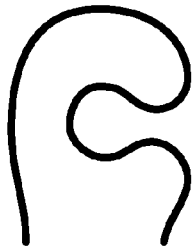
Figure 10:
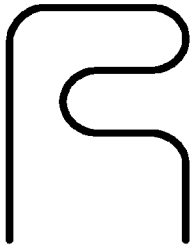
Figure 11:
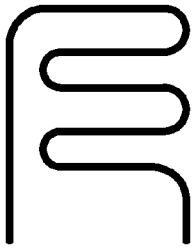
Figure 12:
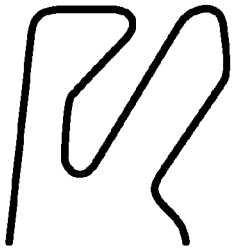
Figure 13:
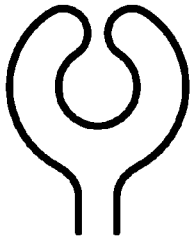
Figure 14:
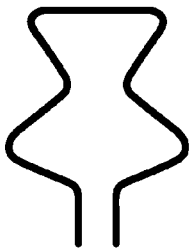
Figure 15:
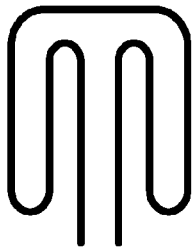
Figure 16:
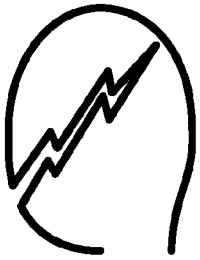
Figure 17:
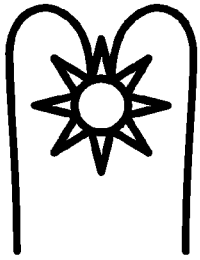
Figure 18:
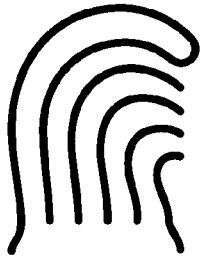
Figure 19:
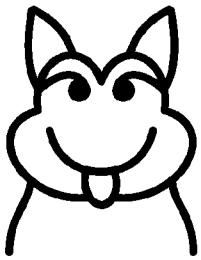
Figure 20:
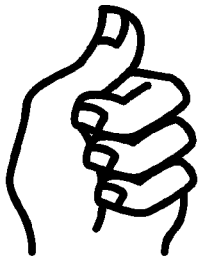
Figure 21:
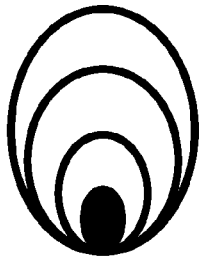

FIG. 6 is a perspective view of other embodiment of a seat frame 410 in accordance with the present invention. This embodiment may be stackable as the back legs may extend laterally about 1 inch.

FIGS. 7-21 illustrate further embodiments of the back portion of the seat frame in accordance with the present invention. In particular, the back portion provides both design elements and a back support. Such designs may include the appearance of letters, abstract designs, stars, animals, and lightening. It will be appreciated that many other recognizable or abstract designs may be incorporated into the chair back of the present invention.

Figure 22:
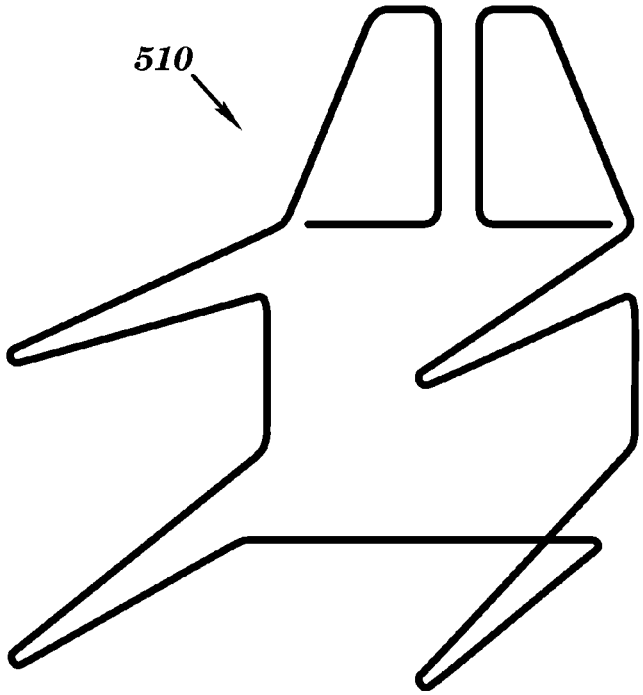
FIGS. 22 and 23 are perspective views of further embodiments of a seat frame formed from a single continuous member or having the appearance of being formed from a single continuous piece of material in accordance with the present invention.
Figure 23:
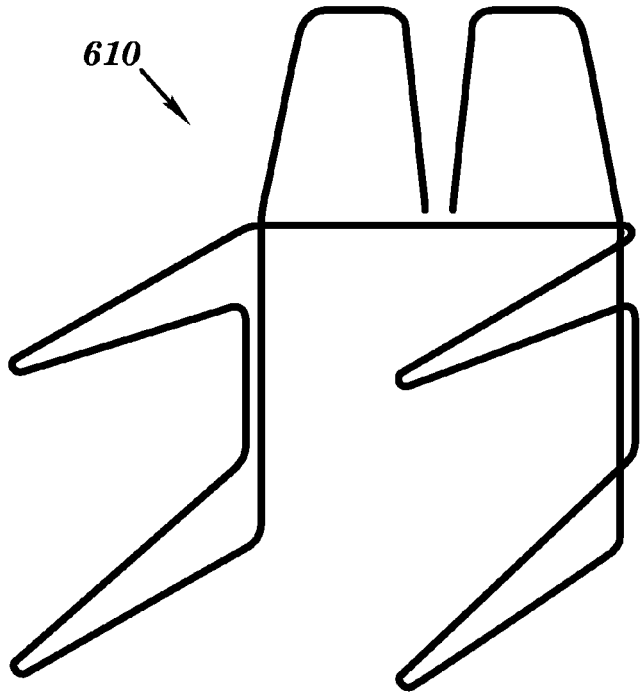

FIGS. 22 and 23 illustrate further embodiments of a seat frame 510 and a seat frame 610 formed from a single continuous elongated member or having the appearance of being formed from a single continuous elongated piece of material in accordance with the present invention. In light of the above description, it will be appreciated by those skilled in the art that other configurations may be employed which provide seat frames formed from a single continuous elongated member or having the appearance of being formed from a single continuous elongated piece of material.

Figure 24:
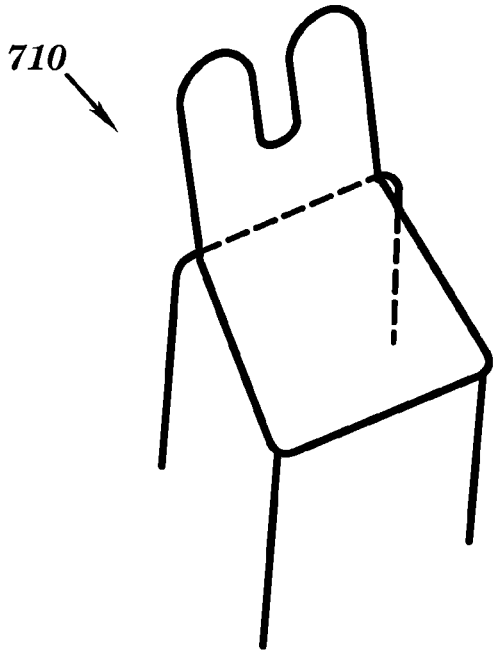
FIG. 24 is a perspective view of a seat frame having a two-piece construction with an integrated back support in accordance with the present invention.

FIG. 24 is an illustration of a seat frame 710 having a two-piece construction with an integrated back support. The back and front legs may be formed from a single continuous elongated member. It will be appreciated that any of the above described and illustrated designs for the back may be incorporated in the two-piece seat frame design.

Figure 25:
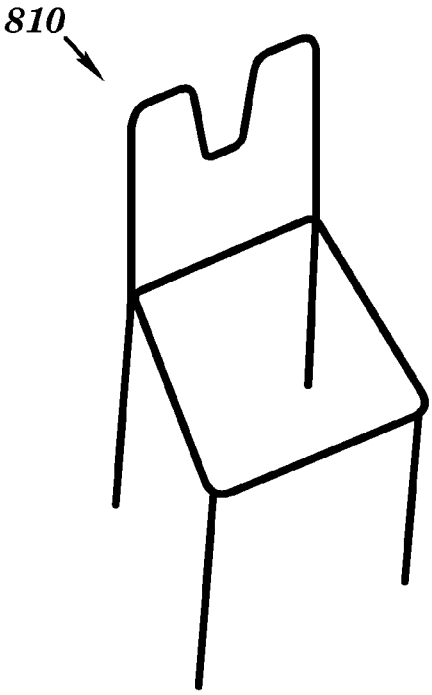
FIGS. 25 and 26 are perspective views of seat frames constructed from a plurality of elongated members and having an integrated back support.
Figure 26:
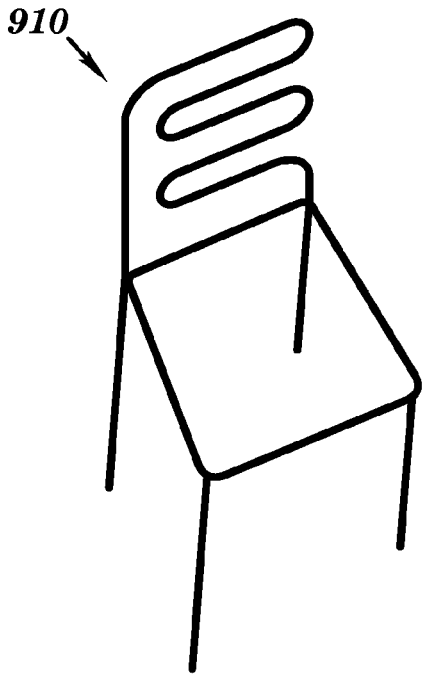

FIGS. 25 and 26 are illustrations of a seat frame 810 and a seat frame 910 constructed from a plurality of elongated members and having an integrated back support. For example, the back and rear legs may be formed from a single continuous elongated member. It will be appreciated that any of the above described and illustrated designs for the back may be incorporated in such a seat frame design.

With regard to the various embodiments, bent tubing may provide a more simple and continuous look. Variations of different size materials or different gauge wires, as a derivative of the frame (or may be as a secondary application) may provide design and back support elements and provide for a more custom back with other design options. Integration of a continuous seat bottom may also be provided. Multiple materials, not limited to metal tubing and wire, may be suitably employed.

While the illustrated embodiments are generally in the form of a seat frame and/or chair, it will be appreciated that the present invention may be incorporated into barstools, counter stools, and other forms of furniture.

Although various embodiments have been depicted and described in detail herein, it will be apparent to those skilled in the relevant art that modifications, additions, substitutions and the like can be made without departing from the spirit of the present invention and these are, therefore, considered to be within the scope of the present invention as defined in the following claims.

The invention claimed is:

1. A seat frame consisting of:

a plurality of legs;

a backrest;

a support for a seat;

wherein said plurality of legs, said backrest, and said support for the seat form said seat frame having an appearance of being integrally formed from a single continuous elongated piece of material having a longitudinal axis along an entire length of the single continuous elongated piece of material and defining a single beginning first end disposed across said longitudinal axis, a single terminating second end disposed across said longitudinal axis, and a single continuous elongated middle portion defining a single continuous uninterrupted course along said entire length of said longitudinal axis between said single beginning first end and said single terminating second end;

wherein portions of said single continuous elongated middle portion define a plurality of spaced-apart elongated horizontally-extending supports extending from a front to a back of said seat frame to form said support for the seat, and said single beginning first end is spaced-apart from said single terminating second end; and wherein said single continuous elongated piece of material comprises a generally constant cross-sectional shape taken about said longitudinal axis and along said entire length of said single continuous elongated piece of material, said backrest formed from a portion of said single continuous elongated middle portion, said single beginning first end disposed across said longitudinal axis and said single terminating second end disposed across said longitudinal axis defining ends of first and second legs of said plurality of legs for supporting said seat frame on a surface so that said single beginning first end and said single terminating second end rest on the surface and adjacent terminating end portions extend directly upwardly away from the surface, and portions of said single continuous elongated middle portion defining ends of third and fourth legs of said plurality of legs for supporting said seat frame on the surface.

2. The seat frame of claim 1 wherein said plurality of legs, said backrest, and said support for the seat are formed from a single continuous elongated member.

3. The seat frame of claim 1 wherein said plurality of legs, said backrest, and said support for the seat are formed from a plurality of elongated members.

4. The seat frame of claim 1 wherein said backrest comprises a design extending across said backrest having the appearance of being formed from said single continuous elongated piece of material.

5. The seat frame of claim 1 wherein said backrest comprises a design representing a recognizable object extending across said backrest having the appearance of being formed from said single continuous elongated piece of material.

6. A chair comprising a seat frame of claim 1, and a seat.

7. The seat frame of claim 1 wherein said single continuous elongated piece of material comprises a metal.

8. The seat frame of claim 1 wherein said single continuous elongated piece of material comprises a tubular material.

9. The seat frame of claim 1 wherein said single continuous elongated piece of material comprises a wire material.

10. The seat frame of claim 1 wherein said single beginning first end disposed across said longitudinal axis and said single terminating second end disposed across said longitudinal axis define ends of two back legs of said plurality of legs for supporting said seat frame on the surface, and portions of said single continuous elongated middle portion define ends of two front legs of said plurality of legs for supporting said seat frame on the surface.

11. A method for forming a seat frame, the method consisting of:

forming at least one of a single continuous elongated member and a plurality of elongated members into a plurality of legs, a backrest, and a support for a seat, and wherein the plurality of legs, the backrest, and the support for the seat form the seat frame having an appearance of being integrally formed from a single continuous elongated piece of material having a longitudinal axis along an entire length of the single continuous elongated piece of material and defining a single beginning first end disposed across the longitudinal axis, a single terminating second end disposed across the longitudinal axis, and a single continuous elongated middle portion defining a single continuous uninterrupted course along the entire length of the longitudinal axis between the single beginning first end and the single terminating second end, and the single continuous elongated piece of material comprise a generally constant cross-sectional shape taken about the longitudinal axis and along the entire length of the single continuous elongated piece of material, the backrest formed from a portion of the single continuous elongated middle portion, the single beginning first end disposed across the longitudinal axis and the single terminating second end disposed across the longitudinal axis defining ends of first and second legs of the plurality of legs for supporting the seat frame on a surface so that said single beginning first end and said single terminating second end rest on the surface and adjacent terminating end portions extend directly upwardly away from the surface, and portions of the single continuous elongated middle portion defining ends of third and fourth legs of said plurality of legs for supporting the seat frame on the surface.

12. The method of claim 11 wherein the forming comprises forming the single continuous elongated member into the plurality of legs, the backrest, and the support for the seat.

13. The method of claim 11 wherein the forming comprises forming the plurality of elongated members into the plurality of legs, the backrest, and the support for the seat.

14. The method of claim 11 wherein the forming comprises forming the backrest having a design extending across the backrest having the appearance of being formed from the single continuous elongated piece of material.

15. The method of claim 11 wherein the forming comprises forming the backrest having a design representing a recognizable object extending across the backrest having the appearance of being formed from the single continuous elongated piece of material.

16. The method of claim 11 further comprising attaching a seat to the support.

17. The method of claim 11 wherein the forming comprises forming portions of the single continuous elongated middle portion to define a plurality of spaced-apart elongated horizontally-extending supports extending from a front to a back of the seat frame to form the support for the seat.

18. The method of claim 11 wherein the forming comprises forming the single continuous elongated middle portion so that the single beginning first end is spaced-apart from the single terminating second end.

19. The method of claim 11 wherein the forming comprises forming portions of the single continuous elongated middle portion to define a plurality of spaced-apart elongated horizontally-extending supports extending from a front to a back of the seat frame to form the support for the seat, and forming the single continuous elongated middle portion so that the single beginning first end is spaced-apart from the single terminating second end.

20. The method of claim 11 wherein the single continuous elongated piece of material comprise a metal.

21. The method of claim 11 wherein the single continuous elongated piece of material comprise a tubular material.

22. The method of claim 11 wherein the single continuous elongated piece of material comprise a wire material.

23. The method of claim 11 wherein the single beginning first end disposed across the longitudinal axis and the single terminating second end disposed across the longitudinal axis define ends of two back legs of the plurality of legs for supporting the seat frame on the surface, and portions of the single continuous elongated middle portion define ends of two front legs of the plurality of legs for supporting the seat frame on the surface.

24. A seat frame consisting of:

a plurality of legs;

a backrest;

a support for a seat;

wherein said plurality of legs, said backrest, and said support for the seat form said seat frame having an appearance of being integrally formed from a single continuous elongated piece of material having a longitudinal axis along an entire length of the single continuous elongated piece of material and defining a single beginning first end disposed across said longitudinal axis, a single terminating second end disposed across said longitudinal axis, and a single continuous elongated middle portion defining a single continuous uninterrupted course along said entire length of said longitudinal axis between said single beginning first end and said single terminating second end, and wherein said single continuous elongated piece of material comprises a generally constant cross-sectional shape taken about said longitudinal axis and along said entire length of said elongated piece of material, said single beginning first end spaced-apart from said single terminating second end, said backrest formed from a portion of said single continuous elongated middle portion, and said single beginning first end disposed across said longitudinal axis and said single terminating second end disposed across said longitudinal axis defining two ends of first and second legs of said plurality of legs for supporting said seat frame on a surface so that said single beginning first end and said single terminating second end rest on the surface and adjacent terminating end portions extend directly upwardly away from the surface, and portions of said single continuous elongated middle portion defining ends of third and fourth legs of said plurality of leas for supporting said seat frame on the surface.

25. The seat frame of claim 24 wherein said plurality of legs, said backrest, and said support for the seat are formed from a single continuous elongated member.

26. The seat frame of claim 24 wherein said plurality of legs, said backrest, and said support for the seat are formed from a plurality of elongated members.

27. The seat frame of claim 24 wherein said backrest comprises a design extending across said backrest formed from said single continuous elongated piece of material.

28. The seat frame of claim 24 wherein said backrest comprises a design extending across said backrest formed from said single continuous elongated piece of material representing a recognizable object.

29. The seat frame of claim 24 wherein said single continuous elongated piece of material comprises a metal.

30. The seat frame of claim 24 wherein said single continuous elongated piece of material comprises a tubular material.

31. The seat frame of claim 24 wherein said single continuous elongated piece of material comprises a wire material.

32. A chair comprising a seat frame of claim 24; and a seat.

33. The seat frame of claim 24 wherein said single beginning first end disposed across said longitudinal axis and said single terminating second end disposed across said longitudinal axis define ends of two back legs of said plurality of legs for supporting said seat frame on a surface, and portions of said single continuous elongated middle portion define ends of two front legs of said plurality of legs for supporting said seat frame on the surface.

* * * * *